US010391349B2

(12) United States Patent
Wailes et al.

(10) Patent No.: US 10,391,349 B2
(45) Date of Patent: Aug. 27, 2019

(54) MUSCLE STRETCHING APPARATUS

(71) Applicant: KRAM Wellness Group, Inc., Leominster, MA (US)

(72) Inventors: Rachelle C. Wailes, Baldwinville, MA (US); John C. Wailes, Baldwinville, MA (US); Heather L. Wailes, Baldwinville, MA (US); David J. Aronson, Leominster, MA (US); Matthew S. Aronson, Leominster, MA (US); Elizabeth A. Schatia, Townsend, MA (US); Kathryn A. Schatia, Townsend, MA (US)

(73) Assignee: KRAM Wellness Group, Inc., Leominster, MA (US)

( * ) Notice: Subject to any disclaimer, the term of this patent is extended or adjusted under 35 U.S.C. 154(b) by 0 days.

(21) Appl. No.: 15/893,605

(22) Filed: Feb. 10, 2018

(65) Prior Publication Data

US 2018/0185692 A1 Jul. 5, 2018

Related U.S. Application Data

(63) Continuation of application No. PCT/US2016/046492, filed on Aug. 11, 2016.

(60) Provisional application No. 62/204,009, filed on Aug. 12, 2015.

(51) Int. Cl.

| | |
|---|---|
| ***A63B 21/002*** | (2006.01) |
| ***A63B 21/00*** | (2006.01) |
| ***A61H 1/02*** | (2006.01) |

(52) U.S. Cl.

CPC ..... *A63B 21/00185* (2013.01); *A61H 1/02* (2013.01); *A63B 21/002* (2013.01); (Continued)

(58) Field of Classification Search

CPC ..... A63B 21/0552; A63B 3/006

See application file for complete search history.

(56) References Cited

U.S. PATENT DOCUMENTS 4,456,249 A * 6/1984 Calabrese ..... A63B 21/154 482/124

4,909,505 A 3/1990 Tee (Continued)

FOREIGN PATENT DOCUMENTS

GB 434067 A 8/1935

*Primary Examiner* — Stephen R Crow

(74) *Attorney, Agent, or Firm* — Louis J. Franco; Law Office of Louis J. Franco

(57) ABSTRACT

A muscle stretching apparatus includes a main loop configured from at least one strap and a handle member within the loop. A foot-rest portion is situated along the loop generally opposite the handle member and, in at least one embodiment, carries a foot saddle fabricated from a durable and flexible material configured to wrap around a portion of a user's foot as the foot exerts force thereon. A strap-constricting device carried by the loop renders the muscle stretching apparatus selectively transfigurable between a first configuration defining the single main loop and a second configuration defining, by selective constriction of the main loop with the strap-constricting device, an upper loop including the handle member and a lower loop including the foot saddle. The handle is variously configured to include a grip and a rolling end cap that rotate relative to one another for implementation in myofascial release and trigger point therapy.

8 Claims, 11 Drawing Sheets

(52) U.S. Cl.
CPC ..... *A63B 21/4015* (2015.10); *A63B 21/4034* (2015.10); *A63B 21/4035* (2015.10); *A61H 2201/0157* (2013.01); *A61H 2201/0192* (2013.01); *A61H 2201/1269* (2013.01); *A61H 2201/164* (2013.01); *A61H 2201/165* (2013.01); *A61H 2201/1635* (2013.01); *A61H 2201/1664* (2013.01); *A61H 2203/0456* (2013.01); *A61H 2205/10* (2013.01); *A63B 2225/09* (2013.01)

(56) References Cited

U.S. PATENT DOCUMENTS

| | | | | | |
|---|---|---|---|---|---|
| 5,069,449 | A * | 12/1991 | Wardwell | A63B 21/151 | 482/126 |
| 5,518,486 | A | 5/1996 | Sheeler | | |
| 5,558,609 | A | 9/1996 | Olschansky et al. | | |
| 6,203,476 | B1 | 3/2001 | Wang et al. | | |
| 7,955,236 | B2 * | 6/2011 | DiGiovanni | A63B 21/0552 | 482/124 |
| 8,282,536 | B2 * | 10/2012 | Latronica | A63B 21/16 | 482/121 |
| 8,608,629 | B2 * | 12/2013 | Latronica | A63B 21/16 | 482/121 |
| 9,914,004 | B2 * | 3/2018 | Hatfield | A63B 21/00185 | |
| 9,937,096 | B2 * | 4/2018 | Aldridge | A61H 1/0237 | |
| 9,962,575 | B2 * | 5/2018 | Askins | A63B 23/025 | |
| 10,226,394 | B2 * | 3/2019 | Aldridge | A61H 1/0237 | |
| 2005/0085350 | A1 | 4/2005 | Shen | | |
| 2010/0285938 | A1 | 11/2010 | Latronica | | |
| 2011/0118094 | A1 | 5/2011 | Kissner et al. | | |
| 2012/0108403 | A1 | 5/2012 | Zandman-Zeman | | |

* cited by examiner

MUSCLE STRETCHING APPARATUS

CROSS-REFERENCE TO RELATED APPLICATION/PRIORITY CLAIMS

The present application is a continuation of International Application Ser. No. PCT/US2016/046492 filed Aug. 11, 2016 pursuant to the Patent Cooperation Treaty, and under the title "MUSCLE STRETCHING APPARATUS." Application PCT/US2016/046492 claimed priority benefits in U.S. Provisional Application No. 62/204,009 filed Aug. 12, 2015 under the title "MUSCLE STRETCHING APPARATUS."

The present application claims the benefit of the filing date of Provisional Application Ser. No. 62/204,009, as well as the filing date of PCT Application No. PCT/US2016/046492, based on the priority chain outlined above. Moreover, the entireties of the disclosures, including the drawings, of both previous applications in the aforesaid priority chain are incorporated herein by reference as if set forth fully in the present application.

BACKGROUND

Various apparatus incorporating straps for a person's autonomously stretching muscles exist. An illustrative example of one such device was disclosed in U.S. patent application Ser. No. 12/948,530 filed in the name of Kissner on No. 17, 2010, and subsequently published on May 19, 2011 as US Publication No. 2011/0118094 A1.

In addition to muscle stretching apparatus incorporating straps, separate devices exist for promoting myofascial release and trigger point therapy. At least some of these devices include one or more rollers for rolling over a person's muscles, myofascial tissue and trigger points.

Presently, the stretching of muscles as part of therapy to treat injury or to prepare for athletic activities such as sports or dancing variously involve one or more apparatus. Moreover, the facilitation of myofascial release requires apparatus entirely separate from those used in the stretching of muscles. Still additional devices are required for trigger point therapy.

Accordingly, a need exists for a single apparatus that consolidates the functionality of previous muscle-stretching, myofascial-release, and trigger-point therapy devices, and which furthermore improves upon extant apparatus for autonomous muscle stretching itself.

SUMMARY

Variously configured embodiments of the present invention combine and facilitate the functionality of at least three previous apparatus. A most basic function of each embodiment is to provide a looped strap for use in stretching, strengthening, and rendering more flexible various muscles of a user's limbs. Additionally, however, each of a plurality of embodiments includes a handle with a cylindrical cushioned grip portion extending between a pair of rolling end caps. The end caps and the grip portion rotate relative to one another and cooperate such that, in alternative modes, (i) the grip portion can engage and roll over the arch of a user's foot, by way of non-limiting example, to promote myofascial release and (ii) the grip portion can be grasped by a user's hand to roll one or both of the end caps over "trigger points" on a person's body, thereby promoting trigger point therapy and/or muscle-tension release.

Broadly characterized, each embodiment includes at least one strap configured to define at least one loop, a handle member incorporated within one of the at least one loops, and a foot-rest portion situated along one of the at least one loops at a location generally opposite the handle member. In most embodiments, each of the at least one straps forming the at least one loop is fabricated from a generally inelastic material. Still further, an exemplary variation has disposed along the foot-rest portion a foot pad—alternatively referred to as "foot saddle"—through which strap material (e.g., synthetic webbing) forming the at least one loop is threaded in order to retain the foot pad along the foot-rest portion. In various versions, the foot saddle is fabricated from a durable and flexible material such as rubber or polymeric material, by way of non-limiting example.

Each of various configurations is selectively transfigurable between a first configuration defining a single loop (i.e., a "single-loop configuration") and a second configuration (i.e., a "two-loop configuration") defining an upper loop including the handle member and a lower loop including the foot-rest portion and, where applicable, the foot saddle. An embodiment is rendered transfigurable by the inclusion of strap-constricting device that is used to selectively constrict the main single loop of a single-loop configuration in order to define and delineate the upper and lower loops of a two-loop configuration.

In one illustrative transfigurable embodiment, a muscle stretching apparatus includes a buckle for selectively opening and closing the loop. The strap-constricting device is configured as a slide defining mutually separated left-side and right-side strap-guiding slots. The slide is slidably carried by a first side of the loop extending between the handle member and the foot-rest portion by the passage of a portion of the strap from which the loop is configured through one of the left-side and right-side strap-guiding slots. The buckle is permanently attached to a buckle-retaining strap end, and situated between the handle member and the foot-rest portion, on a second side of the loop extending between the handle member and foot-rest portion opposite the first side of the loop on which the slide is carried. A free strap end can be alternatively inserted into and removed from the buckle such that the loop can be adjusted in size and alternatively opened and closed. The first configuration is such that only the first side of the loop passes through one of the left-side and right-side strap-guiding slots of the slide, while the second configuration is such that the first side of the loop passes through one of the left-side and right-side strap-guiding slots and the second side of the loop passes through the other of the left-side and right-side strap-guiding slots, thereby defining the constricted region in the main loop that defines and mutually delineates the upper and lower loops.

Another embodiment transfigurable between single-loop and two-loop modes obviates the need to open the main loop characterizing the single-loop configuration. In this embodiment, the strap-constricting device is a snap-fit side-release buckle. The sidle-release buckle includes a buckle male member retained by and on a first side of the main loop between the foot saddle and the handle member. A buckle female member is retained by and on a second side of the loop opposite the first side of the loop and between the foot saddle and the handle member. The female buckle member is configured for selective decoupling and coupling with the buckle male member in order to render the muscle stretching apparatus into, respectively, the first and second configurations.

In addition to the use of the straps and loops for the stretching of muscles, various embodiments incorporate handle members that facilitate myofascial release and trigger point therapy. In one version, a handle comprises a rigid cylindrical handle inner core defining and extending along a handle axis between inner-core first and second ends. The handle inner core further defines and has extending therethrough along the handle axis a strap-passage channel through which the strap forming the loop is threaded in order to retain the handle member on the strap and within the loop.

Coaxially disposed about the handle inner core is a rigid cylindrical handle outer core extending between outer-core first and second ends. The handle outer core is shorter than the handle inner core such that the handle inner-core first and second ends protrude out of the outer-core first and second ends. Moreover, the handle inner and outer cores can rotate relative to one another about the handle axis.

Coaxially affixed about the inner-core first and second ends are, respectively, first and second rolling end caps. Each of the rolling end caps has a circular cross-section with a diameter larger than the diameter of the handle outer core such that it extends radially beyond the handle outer core. Because the handle outer core and the rolling end caps are rotatable relative to one another, the handle outer core and the rolling end caps can be variably and alternative used to roll over muscles, myofascial tissue and trigger points on a user's body.

Representative embodiments are more completely described and depicted in the following detailed description and the accompanying drawings.

DETAILED DESCRIPTION

The following description of variously embodied muscle stretching apparatus is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to restrict the maximum scope of the claims. Moreover, among the various depicted embodiments, like reference numbers are used to refer to similar or analogous components.

Figure 1:
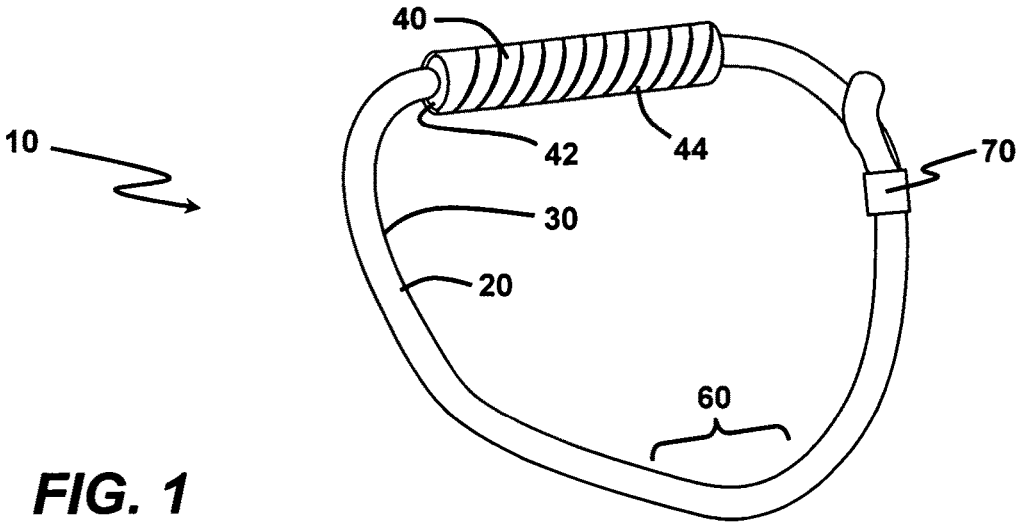
FIG. 1 is a front elevation view of an illustrative muscle stretching apparatus having a single loop formed from a strap and a handle member incorporated within the loop.

Referring initially to FIG. 1, a first embodiment of a muscle stretching apparatus 10 includes a single loop 20 comprising at least one flexible first strap 30 fabricated from a generally inelastic material. In various illustrative versions, the first strap 30 is a webbing fabricated from a polymeric material such as, by way of non-limiting example, nylon, polyester or polypropylene. In the particular example of FIG. 1, the loop 20 consists of a single strap 30, but versions in which a single loop 30 is defined by more than one strap are expressly within the scope and contemplation of the invention.

Disposed about a portion of the length of the first strap 30 is a handle member 40. The handle member 40 comprises at least a rigid tubular handle core 42 into which the first strap 30 is fed and over which there is optionally disposed a cushioning material 44 such as foam or rubber. In addition to providing comfort to a user's hand(s), the cushioning material 44 may be selected to facilitate a large overall coefficient of friction between the handle member 40 and a user's palm and fingers, thereby enhancing the user's grip. Each of various embodiments will typically include a handle member 40 sufficient in length to accommodate grasping by both of a user's hands, but embodiments configured with single-hand handles are also expressly within the scope and contemplation of the invention.

With continued reference to FIG. 1, a foot-rest portion 60 of the loop 20 is situated generally opposite the handle member 40 and is configured for engagement by a user's foot (not shown). The foot-rest portion 60 may be alternatively and interchangeably referred to as a "stirrup," while maintaining use of the same reference number "60." This is particularly the case in association with alternative embodiments comprising two or more loops, which are described later in this specification.

Where the loop 20 consists of a single strap 30, as in the embodiment of FIG. 1, a single buckle (first buckle 70) selectively retains the strap 30 in a loop configuration and facilitates adjustments in the size of the loop 20 and, thereby, adjustments in the distance between the handle member 40 and the opposed foot-rest portion 60. Although the particular type of buckle(s) employed may vary among embodiments, cam buckles are particularly convenient and advantageous. Cam buckles, and their variants (e.g., spring-and-cam buckles) are sufficiently ubiquitous to obviate the need to describe them in detail herein and, therefore, for the sake of brevity, no such description is provided.

Figure 2:
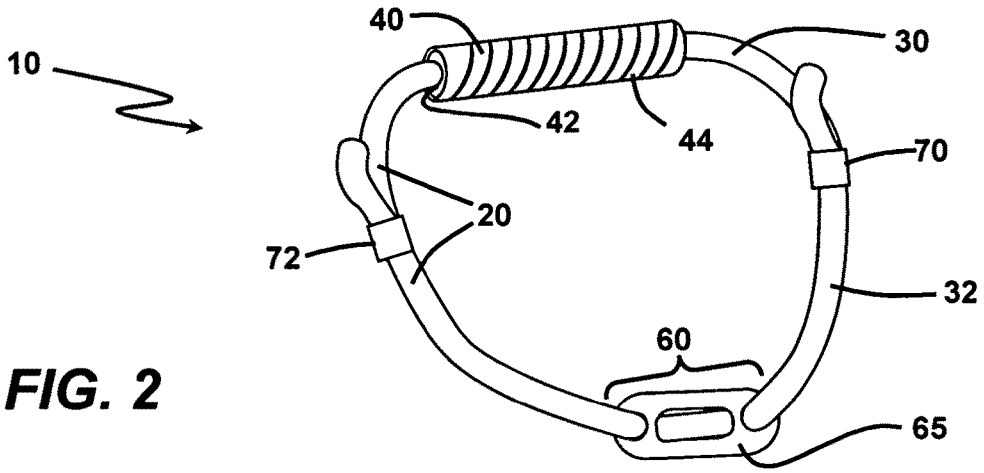
FIG. 2 depicts an illustratively embodied muscle stretching apparatus configured similarly to the embodiment of FIG. 1, but distinguishable in that the loop is formed from two straps and further incorporates a foot saddle situated generally opposite the handle member.

Referring now to FIG. 2, a second embodiment of a muscle stretching apparatus 10 is depicted and described. Like the first embodiment of FIG. 1, the second embodiment is defined by a single loop 20. However, in the embodiment of FIG. 2, the stirrup 60 further includes a foot pad 65 through which the loop 20 is threaded in order to retain the foot pad 65 along the foot-rest portion 60. The foot pad 65 increases the surface area over which the user's foot or lower leg exerts force during stretching. In various versions, the foot pad 65 is fabricated from a durable and flexible material such as rubber, by way of non-limiting example, which wraps around a portion of user's foot as force is exerted. Although a version in accordance with the second embodiment can be fabricated using a single (first) strap 30, as in the version of FIG. 1, in the illustrative version of FIG. 2, the single loop 20 is defined by first and second straps 30 and 32 adjustably joined by first and second buckles 70 and 72.

Figure 3:
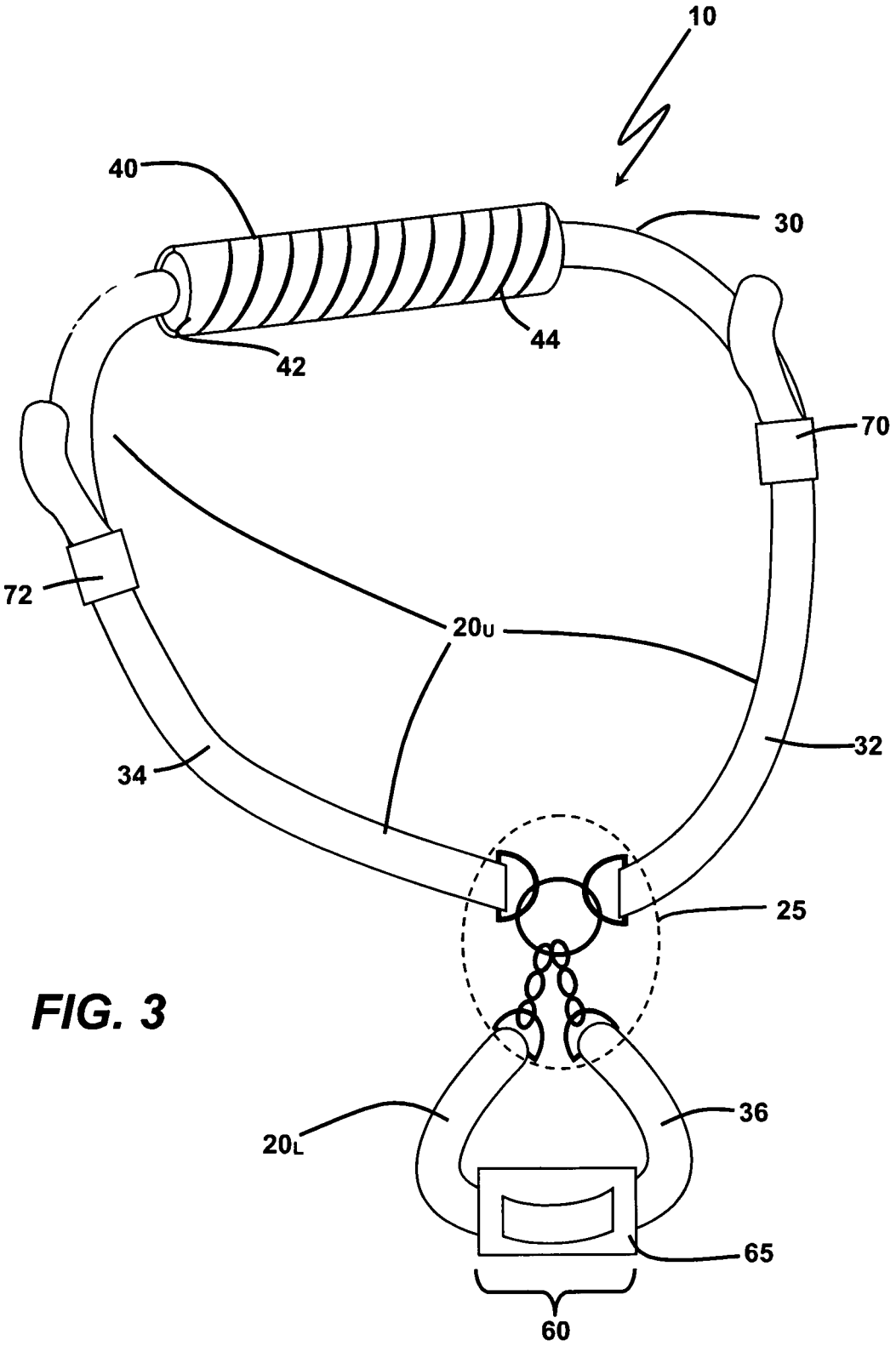
FIG. 3 depicts a muscle stretching apparatus having distinct upper and lower loops incorporating, respectively, a handle member and a foot saddle, and furthermore being joined to one another through a loop linkage.

FIG. 3 depicts a third illustrative embodiment of a muscle stretching apparatus 10. The embodiment of FIG. 3 is differentiated in part from those of FIGS. 1 and 2 in that the third embodiment includes mutually distinct upper and lower loops $\mathbf{20}_U$ and $\mathbf{20}_L$, each of which is fabricated from a generally inelastic material such as the webbing previously described. Moreover, a loop-linking member 25 is interposed between, and mutually connects, the upper and lower loops $\mathbf{20}_U$ and $\mathbf{20}_L$.

Although, in the embodiment of FIG. 3, the upper loop $\mathbf{20}_U$ is actually comprised of first, second and third straps 30, 32 and 34, it will be appreciated that the upper loop $\mathbf{20}_U$ could be configured by as few as one or two straps in a manner similar to the single-loop first and second embodiments of FIGS. 1 and 2. However, the use of three straps as shown in FIG. 3 facilitates a side-to-side balance in length adjustment of the upper loop $\mathbf{20}_U$ and, relatedly, the retention of the loop-linking member 25 in a "centered" position between ends of two of the straps. As clearly depicted, the upper loop $\mathbf{20}_U$ includes the handle member 40, and is designated as the "upper loop $\mathbf{20}_U$" for this reason.

With continued reference to the non-limiting illustrative embodiment of FIG. 3, the lower loop $\mathbf{20}_L$ consists of a single strap 36 of fixed length. However, it should be understood that included within the scope and contemplation of the invention are versions in which the lower loop $\mathbf{20}_L$ is defined by two or more straps. Moreover, versions in which the length of the lower loop $\mathbf{20}_L$ is adjustable are also contemplated, irrespective of the number of straps from which the lower loop $\mathbf{20}_L$ is configured. As indicated by like reference numbers in common with those of the embodiments of FIGS. 1 and 2, in the embodiment of FIG. 3, the foot-rest portion 60 is defined along the lower loop $\mathbf{20}_L$, which also includes a foot saddle 65 retained by the lower loop $\mathbf{20}_L$. The lower loop $\mathbf{20}_L$ alternatively supports insertion of—and application of force by—the lower leg of a user during certain stretching exercises, and even the hand or arm during alternative sets of stretches and exercises for which the handle member 40 is engaged by the user's foot or lower leg.

The loop-linking member 25 can be alternatively configured among variants of this embodiment, but for purposes of one subset of variants, it is intended that the loop-linking member 25 be non-elastic. In this particular case, the loop-linking member 25 comprises one or more metal rings (shown, but not numbered). Because the loop-linking member 25 may be variously configured from one or more rings or links, the loop-linking member 25 may be alternatively and interchangeably referred to as "loop linkage," using the same reference number "25." Among other advantages realized by joining upper and lower loops $\mathbf{20}_U$ and $\mathbf{20}_L$ through an interposed loop linkage 25 is that the upper and lower loops $\mathbf{20}_U$ and $\mathbf{20}_L$ can swivel relative to one another, thereby obviating strap twisting that can be encountered while using either of the embodiments depicted in FIGS. 1 and 2 when, for example, the handle member 40 is brought substantially out of parallel with the foot-rest portion 60/foot saddle 65.

Figure 4:
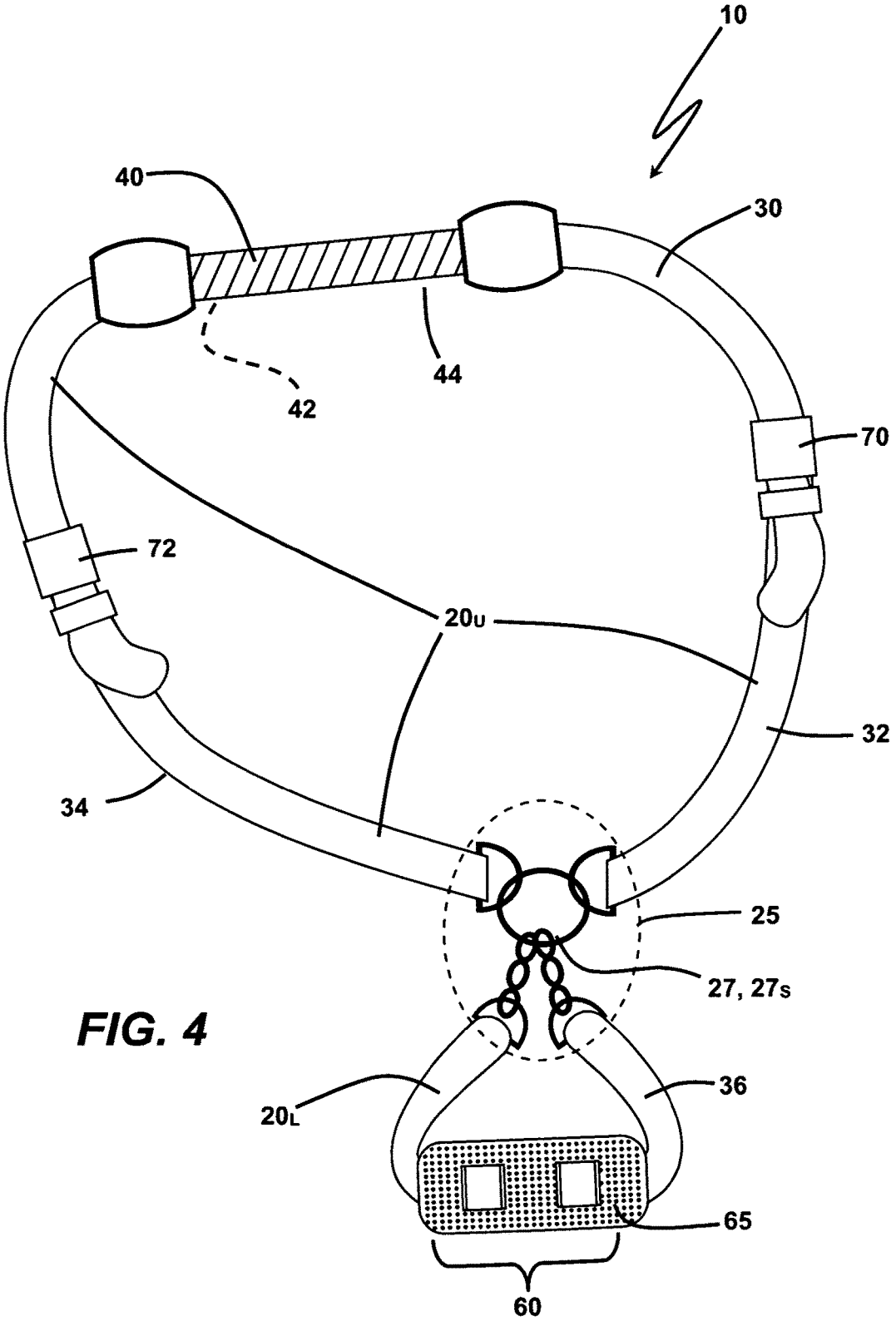
FIG. 4 illustrates an embodiment similar to that of FIG. 3 wherein the loop linkage further includes a biasing member for providing a restorative force between the upper and lower loops.

With conjunctive reference to FIG. 4, another illustrative configuration is shown and described. For simplicity and brevity in explanation, the embodiment of FIG. 4 can be conceptualized as a modified version of the embodiment of FIG. 3. Like the version of FIG. 3, the version of FIG. 4 includes mutually distinct upper and lower loops $\mathbf{20}_U$ and $\mathbf{20}_L$, each of which is fabricated from a generally inelastic material, such as the aforesaid "webbing." A principal difference in the variant of FIG. 4 is that there is included in association with the loop linkage 25 a biasing member 27 that provides a restorative force such that a user can linearly displace the lower loop $\mathbf{20}_L$ relative to (e.g., away from) the upper loop $\mathbf{20}_U$ and then, when the displacement force exerted by the user is removed, the lower and upper loops $\mathbf{20}_L$ and $\mathbf{20}_U$ return to their original, non-displaced relative positions (i.e., they will move back toward one another by virtue of the is restorative force). The biasing member 27 can be variously configured and could include, by way of non-limiting example, at least one of (i) a coiled metal spring $\mathbf{27}_S$ (shown) and (ii) a link fabricated from a material exhibiting a memory property, such as rubber (not shown).

Figure 5A:
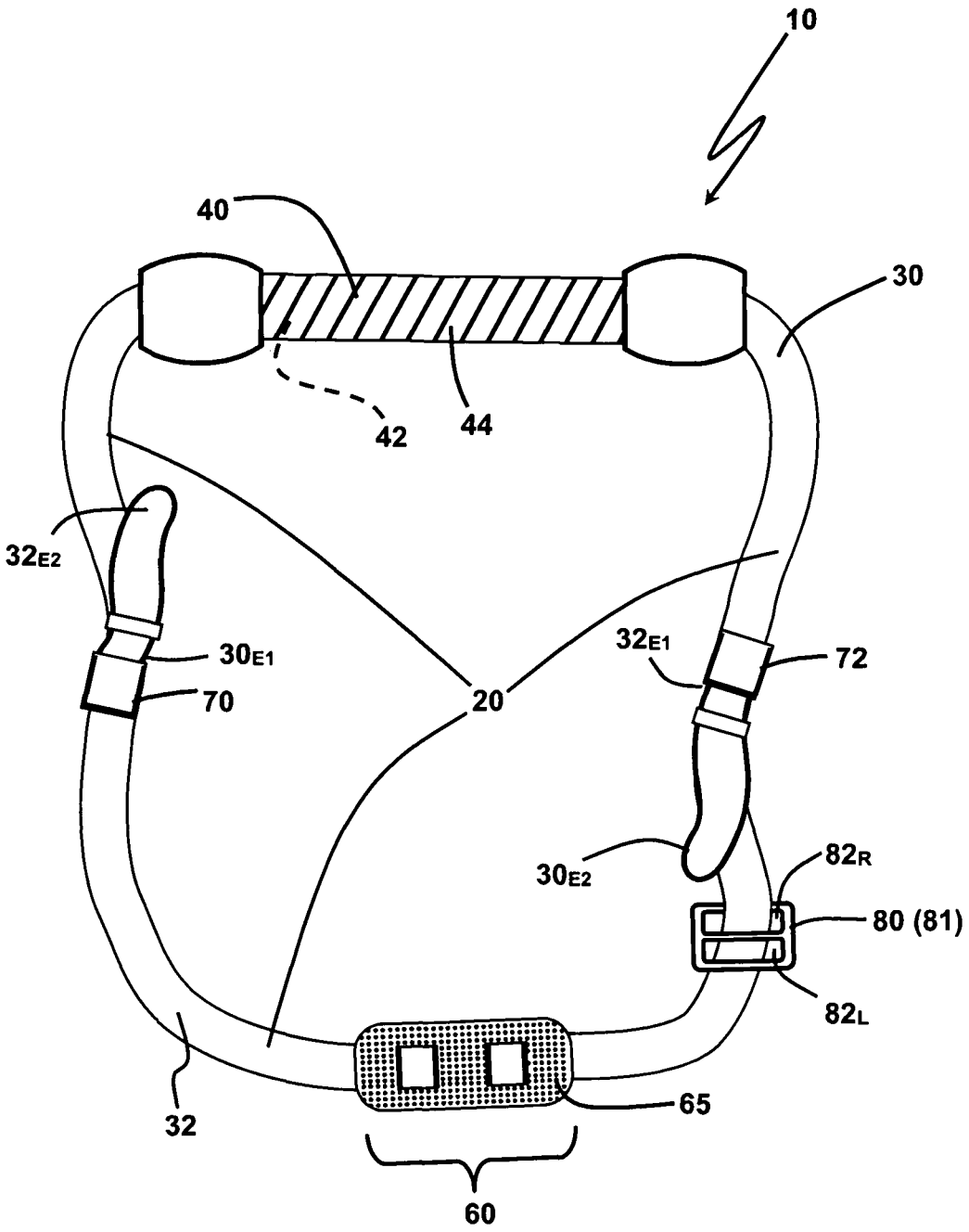
FIGS. 5A-5C show the same illustrative embodiment of muscle stretching apparatus that is selectively transfigurable between a single-loop mode, as shown in FIG. 5A, and a two-loop mode, as shown in FIG. 5C, with FIG. 5B representing a state of transition between the two modes.
Figure 5B:
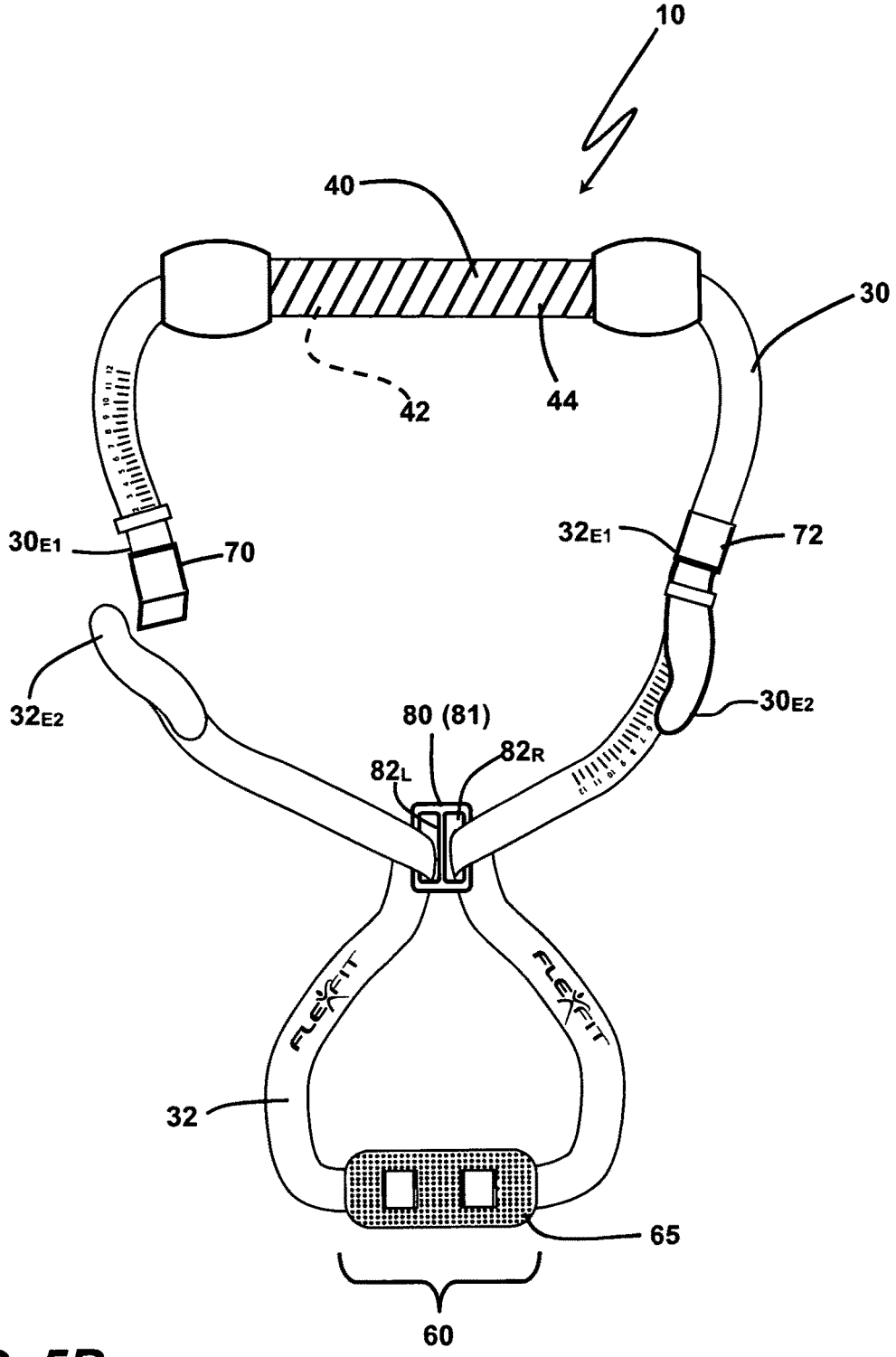
Figure 5C:
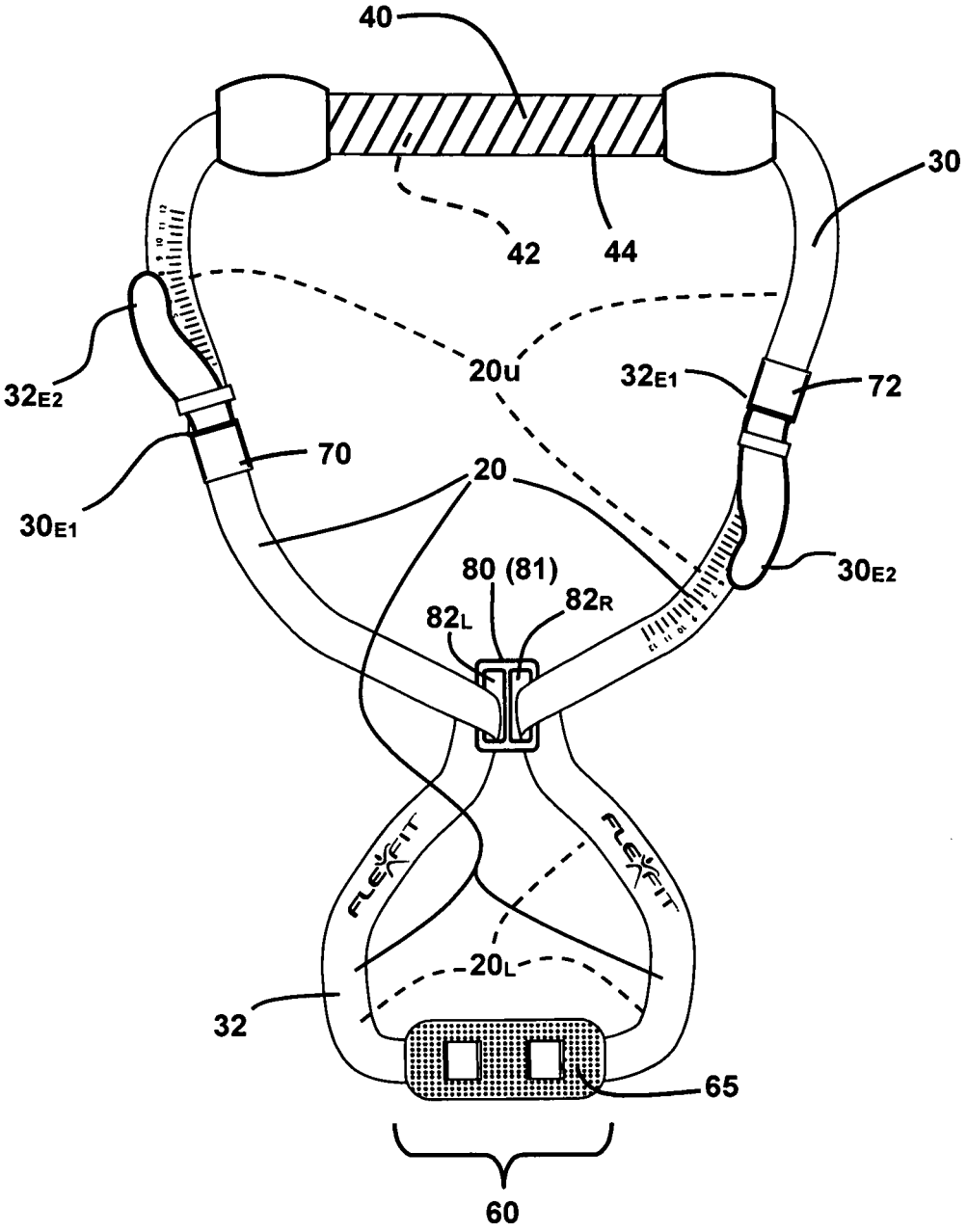

Shown in FIGS. 5A through 5C is an embodiment that can be readily transfigured between a first configuration in which it functions very similarly to a single-loop embodiment, such as that shown in each of FIGS. 1 and 2, and a second configuration in which it simulates much of the functionality of an embodiment having mutually distinct upper and lower loops $\mathbf{20}_U$ and $\mathbf{20}_L$ with a loop linkage 25 situated therebetween. Moreover, when in the second configuration, the embodiment of FIGS. 5A through 5C readily facilitates at least one function not readily realizable by the dual-loop embodiments hereinbefore described.

For purposes of explanation, consideration is given first to FIG. 5A in which the transfigurable embodiment of FIGS. 5A-5C is in a "single-loop configuration." In this particular case, the single loop 20 is comprised of first and second straps 30 and 32 adjustably joined by first and second buckles 70 and 72 situated on, respectively, first and second sides (e.g., left and right sides) and of the loop 20, not unlike the embodiment of FIG. 2. However, it will be readily appreciated, based on the functionality to be described, that this transfigurable embodiment could be comprised of a single strap 30, like the embodiment of FIG. 1, or of three or more straps. Nevertheless, for the purposes of describing other illustrative elements of this embodiment, principal reference will be made to the specific two-strap version of FIGS. 5A-5C, and first and second straps 30 and 32 in particular.

The first strap 30, which passes through the handle member 40, extends between a buckle-retaining strap first end $\mathbf{30}_{E1}$ and a free strap second end $\mathbf{30}_{E2}$ opposite the strap first end $\mathbf{30}_{E1}$. In this particular case, the first buckle 70 is fixedly retained at and by the strap first end $\mathbf{30}_{E1}$ such that it cannot slide along the length of the first strap 30. More specifically, although the details are not depicted because they will be readily understood through textual description alone, a length of first strap 30 is folded over itself to form a loop at the strap first end $\mathbf{30}_{E1}$, and the overlapping portions of the strap are fastened together (e.g., sewn, riveted, fused or epoxied) with a retaining rod or pin of the first buckle 70 trapped within the strap loop in order to retain the first buckle 70, while allowing pivoting of the first buckle 70 with respect to the first strap 30.

Analogously, the second strap 32 extends between a buckle-retaining strap first end $\mathbf{32}_{E1}$ and a free strap second end $\mathbf{32}_{E2}$ opposite the strap first end $\mathbf{32}_{E1}$. The second buckle 72 may be retained at and by the strap first end $\mathbf{32}_{E1}$ of second strap 32 in a manner similar to which the first buckle 70 is retained at and by the strap first end $\mathbf{30}_{E1}$ of the first strap 30.

The embodiment of FIGS. 5A-5C further includes a strap-constricting device 80 which, in this embodiment, is configured as a slide 81 defining mutually separated left-side and right-side strap-guiding slots $\mathbf{82}_L$ and $\mathbf{82}_R$, the distinguishing designations of "left-side" and "right-side" being entirely arbitrary depending on which way a user is holding the apparatus 10. In the version depicted, each strap-guiding slot $\mathbf{82}_L$ and $\mathbf{82}_R$ is bounded on all sides and configured such that at least a single thickness of a predetermined strap—second strap 32 in this case—can be threaded (fed) therethrough.

When the muscle-stretching apparatus 10 is in its single-loop configuration, as in FIG. 5A, only one of the strap-guiding slots $\mathbf{82}_L$ and $\mathbf{82}_R$ need be occupied by a portion of the second strap 32. As indicated in the discussion in association with FIG. 5A above, the first buckle 70 depends from the strap first end $\mathbf{30}_{E1}$ of the first strap 30, which is the same strap about which, or along which, the handle member 40 is supported. In this regard, the first strap 30 can be regarded as an "upper strap" in connection with this embodiment. Accordingly, the second strap 32 can be regarded as a "lower strap," as it includes the foot-rest portion 60 and, in this case, a foot pad 65.

FIG. 5B illustrates an intermediate step in the transfiguration of muscle stretching apparatus 10 from the configuration of FIG. 5A to that of 5C. Because (i) the lower, second strap 32 carries the slide 81 and (ii) neither of buckles 70 and 72 can pass through the strap-guiding slots $\mathbf{82}_L$ and $\mathbf{82}_R$, the first buckle 70 depending from the first strap 30 is opened to release the strap second end $\mathbf{32}_{E2}$ of the second strap 32 which, in FIG. 5B, is shown decoupled from the first buckle 70 such that the loop 20 is open.

Notice also that the slide 81 is retained on that portion of the lower second strap 32 extending between the foot pad 65 and the strap first end $\mathbf{32}_{E1}$ of the second strap 32, the reason for which will be rendered apparent.

Referring now to both of FIGS. 5B and 5C, the transfiguration is completed by threading the decoupled strap second end $\mathbf{32}_{E2}$ of the second strap 32 through whichever of the strap-guiding slots $\mathbf{82}_L$ and $\mathbf{82}_R$ is not occupied by the portion of strap 32 on the other side of the foot-rest portion 60 which, in this example, is left-side strap-guiding slot $\mathbf{82}_L$. After threading the strap second end $\mathbf{32}_{E2}$ of the second strap 32 through the slide 81, the still-decoupled strap second end $\mathbf{32}_{E2}$ is inserted into the open first buckle 70 and pulled therethrough to the desired location. The first buckle 70 is then closed to clamp down on the second strap 32 and retain it in place. As shown in FIGS. 5B and 5C, embodiments may variously including gradation markings (not referred to by number, but clearly indicated) in order to facilitate consistent strap-length/loop-size settings among users or by a single user for disparate stretches or exercises.

As shown in FIG. 5C, the second operative configuration of the embodiment of FIGS. 5A-5C still technically defines a single loop 20 comprised of first and second straps 30 and 32. However, because portions of the second strap 32 are retained in close proximity to one another by slide 81 along a "constricted region" or "constriction," the configuration functions very similarly to an embodiment having two distinct upper and lower loops $\mathbf{20}_U$ and $\mathbf{20}_L$, such as the illustrative embodiments of FIGS. 3 and 4. Accordingly, in FIG. 5C, that portion of the single loop 20 situated above the constriction defined by the slide 81 is identified as an upper loop $\mathbf{20}_U$ and indicated in phantom lead lines. Similarly, that portion of the single loop 20 situated below the constriction defined by the slide 81 is identified as a lower loop $\mathbf{20}_L$ and is also indicated in phantom lead lines.

While the "two-loop" configuration of FIG. 5C is functionally analogous to the two-loop embodiments of FIGS. 3 and 4, for example, there is at least one difference. Because the upper and lower loops $\mathbf{20}_U$ and $\mathbf{20}_L$ in the embodiment of FIG. 5C are separated by a slide 81, the relative sizes of these loops $\mathbf{20}_U$ and $\mathbf{20}_L$ readily change, even while the apparatus 10 is in use. For instance, if a user slips his or her foot into the lower loop $\mathbf{20}_L$ for resting on the foot pad 65, the lower loop $\mathbf{20}_L$ will constrict as the user pulls on the handle member 40 until the slide is situated just above the top portion of the foot. When the user allows slack in the straps 30 and 32, the slide 81 can be slid upwardly to increase the size of the lower loop $\mathbf{20}_L$ and free the foot. This feature is useful for engaging different body parts of the same user, such as the foot, the lower leg, the upper leg and even the hand, or for accommodating the corresponding body parts of a different user. This is distinguishable from the embodiments of FIGS. 3 and 4 in which the lower loop $\mathbf{20}_L$, while perhaps adjustable while not in use, remains relatively constant in size during use.

Figure 6:
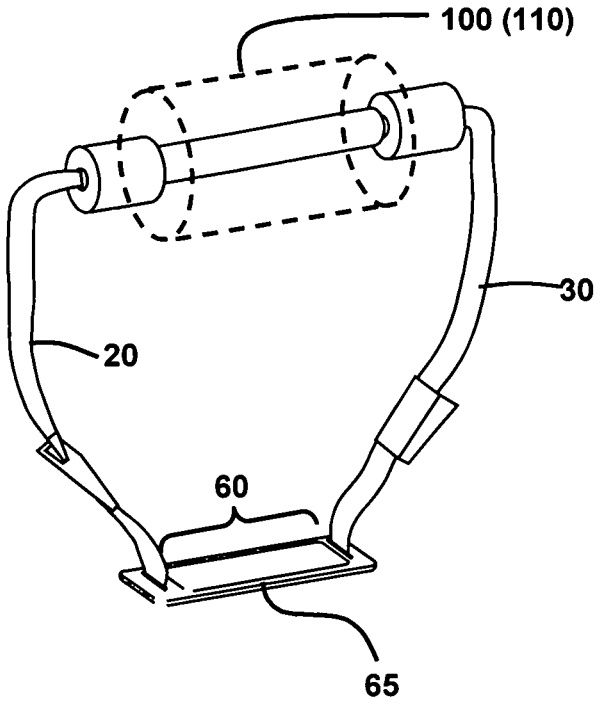
FIG. 6 depicts a muscle stretching apparatus including a handle member with at least one removable end cap that permits a user to open the loop and mount a roller over the handle member.
Figure 6A:
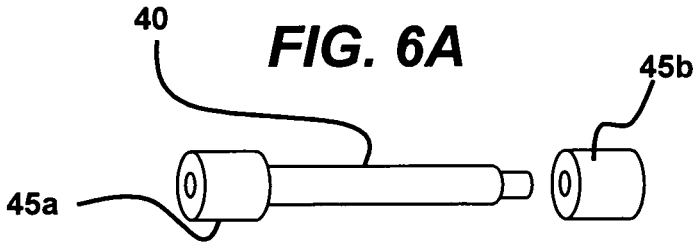
FIG. 6A shows the handle member of the apparatus of FIG. 6 with an end cap removed.

With reference to FIGS. 6 and 6A, an aspect that can be variously incorporated into any of the illustrative embodiments is described. More specifically, whereas a strap including a handle member 40 has previously been described as passing through the handle member 40, FIGS. 6 and 6A depict a handle member 40 including first and second end caps 45*a* and 45*b* included on respective ends of the handle member 40, wherein at least one of the end caps 45*a* and 45*b* is removable. For purposes of explanation, end cap 45*b* is depicted in FIG. 6A as removable.

When one end cap 45*b* is removed, the loop 20 defined by at least one strap 30 and the handle member 40 can be opened. With the loop 20 opened at the handle member 40, as in FIG. 6A, a user can install or remove cylinders 100 (e.g. of foam or rubber—shown in phantom) of disparate diameters in order to perform myofascial release exercises by, for example, rolling the cylinder back-and-forth on a floor with one's foot, calf or other body part. During such exercises, a user could use the foot-rest portion 60/foot pad 65 as a handle. The installed cylinder 100 and handle member 40 cooperate such that the cylinder 100 rotates about the handle member 40, thereby functioning as a roller 110.

Figure 7A:
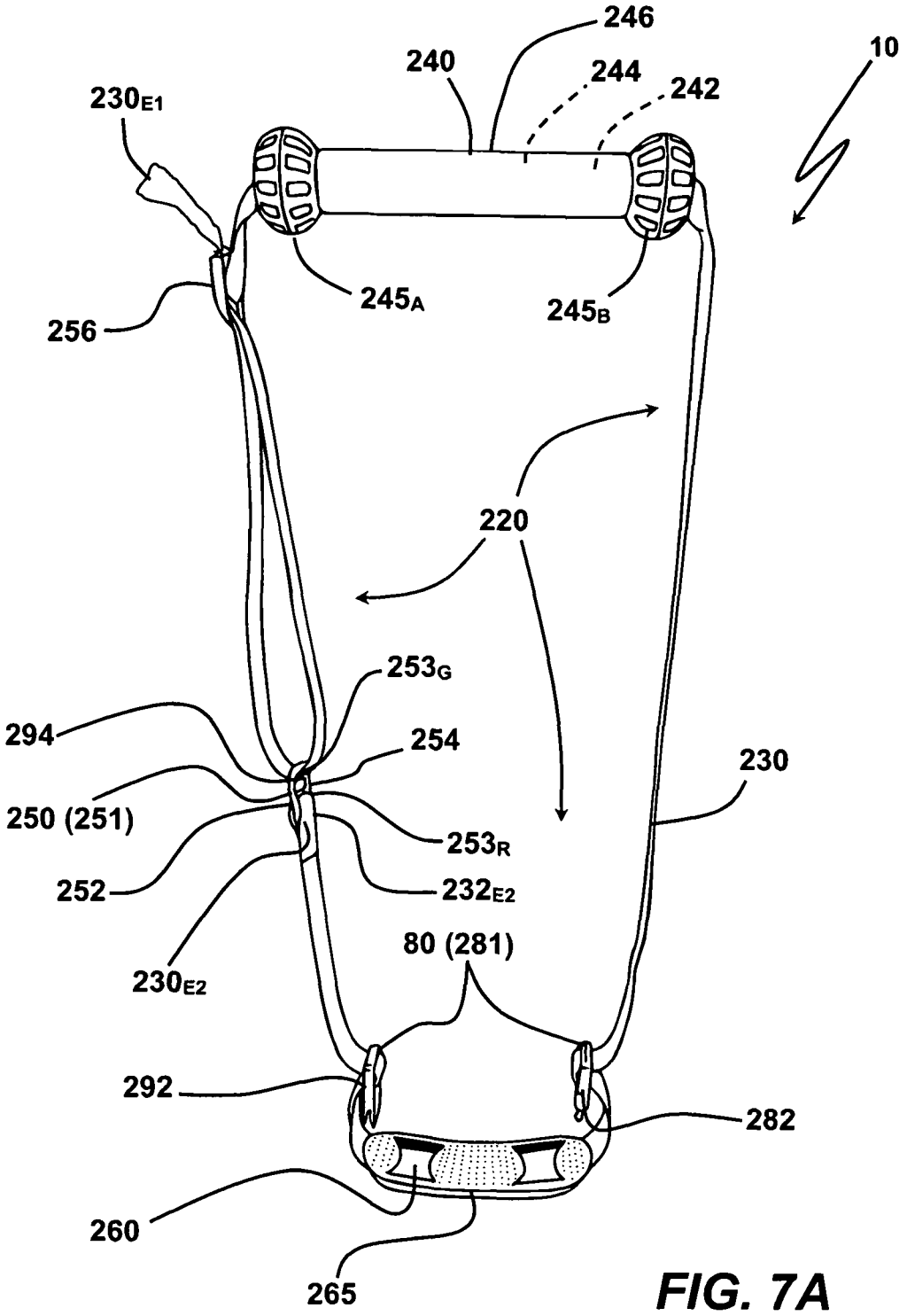
FIG. 7A depicts in a single-loop configuration a muscle stretching apparatus transfigurable between single-loop and two-loop modes.
Figure 7B:
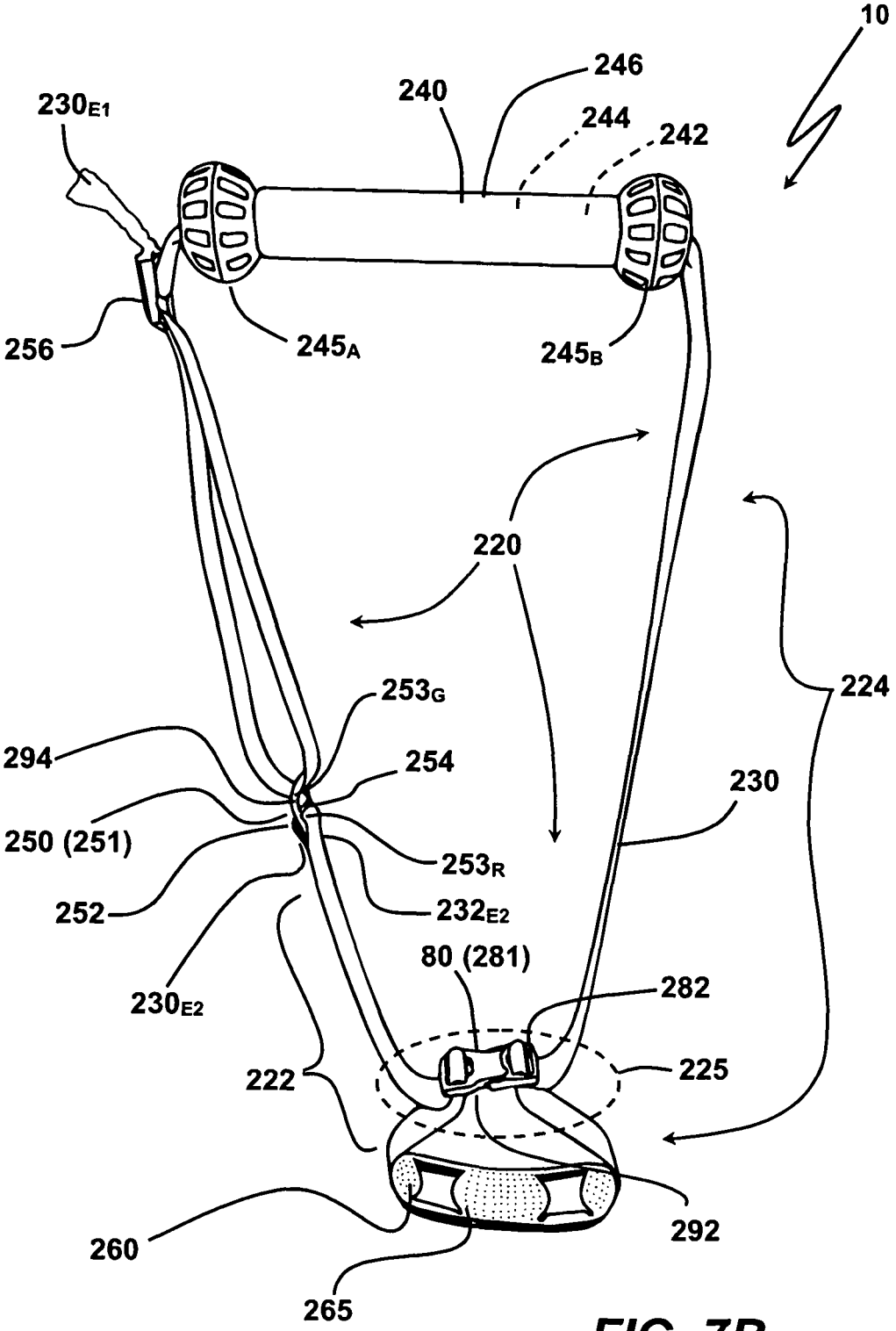
FIG. 7B illustrates the muscle stretching apparatus of FIG. 7A in a two-loop configuration.

In conjunction with FIGS. 7A and $\mathbf{7}_B$, an alternative variation of a transfigurable embodiment is shown and described. In general terms, the version of FIGS. 7A and $\mathbf{7}_B$, like the version of FIGS. 5A-5C, is transfigurable between a first mode, or "single-loop configuration," and a second mode, or "two-loop configuration." The embodiment and modes of FIGS. 7A and 7B are in most material respects analogous to the embodiment and modes of FIGS. 5A and 5C. However, one principal difference between the embodiment of FIGS. 7A and 7B and that of FIGS. 5A-5C is in the strap-constricting device 80 used to facilitate transfiguration between the single-loop and two-loop modes. Whereas the transfiguration of the embodiment of FIGS. 5A-5C is a multi-step procedure, as previously described in detail, transfiguration of the embodiment of FIGS. 7A and 7B is rendered quick and a simple by the replacement of the slide 81 with a side-release buckle 281 as the strap-constricting device 80.

In the particular version of the muscle stretching apparatus 10 shown in FIGS. 7A and 7B, a "main" single loop 220 is configured from a single strap 230 of flexible material. However, as with the embodiments previously described, versions in which a single loop 220 is defined by more than one strap are within the scope and contemplation of the invention. The strap 230 includes, and extends lengthwise between, opposed strap first and second ends $\mathbf{230}_{E1}$ and $\mathbf{230}_{E2}$. Although the designations of the strap ends as strap first and second ends $\mathbf{230}_{E1}$ and $\mathbf{230}_{E2}$ is at the outset entirely arbitrary, for purposes of consistency in the description, the strap first end $\mathbf{230}_{E1}$ is a "free end," while the strap second end $\mathbf{230}_{E2}$ carries a strap-doubling member 250, the purposes of which are more fully explained later in the present description.

It is sufficient for present purposes to note that the strap-doubling member 250 of the embodiment of FIGS. 7A and 7B is configured as a slide 251 with a peripheral slide frame 252 defining a strap-retaining slot $\mathbf{253}_R$ and a strap-guiding slot $\mathbf{253}_G$. Although versions in which the strap-retaining and strap-guiding slots $\mathbf{253}_R$ and $\mathbf{253}_G$ are a single slot serving both functions are within the scope and contemplation of the invention, in the illustrative non-limiting version of FIGS. 7A and $\mathbf{7}_B$, the strap-retaining and strap-guiding slots $\mathbf{253}_R$ and $\mathbf{253}_G$ are distinct slots separated and defined by frame-bifurcating slide bar member 254. Moreover, in this particular case, the slide 251 is retained at and by the strap second end $\mathbf{230}_{E2}$ by a length of strap 230 that has been fed (or "threaded") through the strap-retaining slot $\mathbf{253}_R$ and folded over itself to form a retaining loop $\mathbf{232}_{E2}$ at the strap second end $\mathbf{230}_{E2}$. Overlapping portions of the strap 230 are fastened together (e.g., sewn, riveted, fused or epoxied) with a portion of the peripheral slide frame 252 trapped within the retaining loop $\mathbf{232}_{E2}$ in order to retain the strap-doubling member 250 (slide 251), while allowing pivoting of the strap-doubling member 250 with respect to the strap 230.

In respects similar to embodiments previously discussed, the configuration of FIGS. 7A and 7B includes a handle member 240 through which the strap 230 passes and a foot-rest portion 260 defined along the loop 220 in a location generally opposite that of the handle member 240. Moreover, as with other versions, the foot-rest portion 260 may carry a foot pad 265 (alternatively referred to as "foot saddle 265") through which the loop 220 is fed in order to retain the foot saddle 265 along the foot-rest portion 260.

With continued reference to FIGS. 7A and 7B, the strap 230 passes through the handle member 240, and the loop 220 is completed by passing the strap first end $\mathbf{230}_{E1}$ through the strap-guiding slot $\mathbf{253}_G$ of the slide 251 carried by the strap second end $\mathbf{230}E_2$. While the strap 230 can slide freely within, and relative to, the strap-guiding slot $\mathbf{253}_G$ in order to facilitate adjustment in the length of the loop 220, the maximum length of the strap 230 can be temporarily set by virtue of the inclusion of a strap keeper 256. The strap keeper 256 is essentially any suitable device for holding two adjacent portions of the strap 230 together and, when desired, preventing them from sliding with respect to one another, thereby selectively retaining the loop 220 to a fixed, desired length. Accordingly, while not so limited, various buckle types would fall within the scope of the term "strap keeper" in this context. In fact, throughout the specification and claims, the terms "strap keeper" and "buckle" may be used interchangeably where the desired functionality of a device renders such interchangeability contextually appropriate.

As shown, a portion of the length of the strap 230 between the strap first end $\mathbf{230}_{E1}$ and the handle member 240 carries a strap keeper 256. During initial set up (e.g., assembly or manufacture), and completion of the loop 220 by the passage of the strap first end $\mathbf{230}_{E1}$ through the strap-guiding slot $\mathbf{253}_G$ of the strap-doubling member 250 (e.g., slide 251), the strap 220 is "doubled over" itself, and the strap first end $\mathbf{230}_{E1}$ threaded through the strap keeper 256 alongside the portion of the strap 230 along which the strap keeper 256 is retained. That is, the strap 230 is passed through the strap keeper 256 twice, as is generally known, at least to one of ordinary skill in the relevant arts.

The functionality and general configuration of an illustrative strap keeper 256 will be familiar to most anyone who has seen how the straps of a backpack are adjusted and selectively "set" at a predetermined length such that the strap length does not change when the load is strapped to one's back and carried. Similarly, the strap keeper 256 is a device the allows a user to adjust the length of the loop 220 (i.e., the distance between the handle member 240 and the foot-rest portion 260) when there is no tensile load being applied to the loop 230, but which maintains the set length when a load is applied by a user, for example, grasping the handle member 240 while applying with his or her foot a force the places the loop 220 under tension. The length of the loop 220 is adjusted by sliding one or both portions of the strap 230 relative to the strap keeper 256 through which it passes. Additionally, the strap keeper 256 of various embodiments facilitates opening and closing of the main loop 220 to permit selective removal and installation of components including, for example, the handle member 240 and the foot saddle 265.

As indicated in the opening paragraph descriptive of FIGS. 7A and 7B, the muscle stretching apparatus 10 depicted therein is transfigurable from a single-loop mode to a two-loop mode through use of a "snap-fit" side-release buckle 281 as the strap-constricting device 80 in place of, for example, the slide 81 of the embodiment of FIGS. 5A-5C. In recognition of the fact that side-release buckles are ubiquitous and familiar from their inclusion on, for instance, backpacks, boots, sporting equipment, tents and belts, a minimalist description of same provides sufficient disclosure to both enable embodiments of the invention and support claims incorporating same within their scope. Moreover, functionality of the strap-constricting device 80 is of primary concern; irrespective of its particular configuration, the strap-constricting device draws toward one another, and retains in close proximity, portions of left and right (or "first" and "second") sides 222 and 224 of the main loop 220 in order to define a constricted region 225 within the main loop 220, thereby defining and mutually delineating upper and lower loops $\mathbf{220}_U$ and $\mathbf{220}_L$.

Figure 7C:
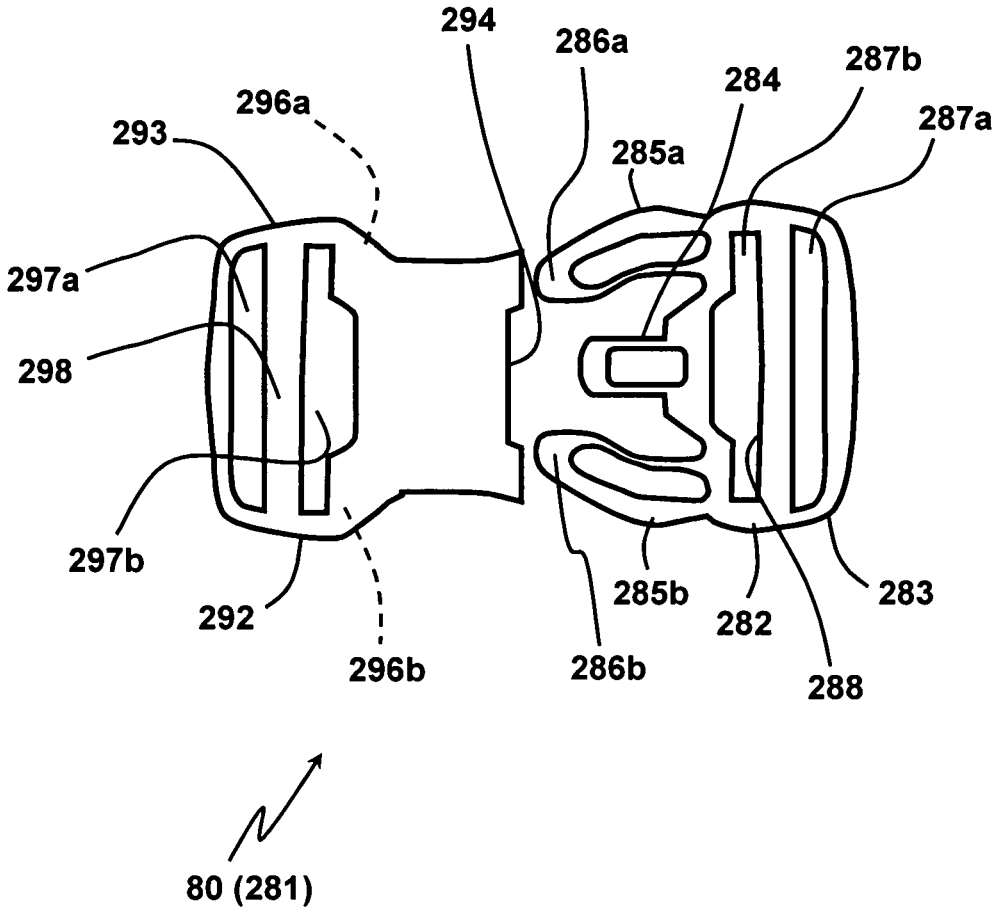
FIG. 7C shows a snap-fit side-release buckle such as that incorporated into the apparatus of FIGS. 7A and 7B in order to facilitate transfiguration of same.

Referring to the enlarged view of FIG. 7C, in addition to FIGS. 7A and 7B, an illustrative side-release buckle 281 includes a buckle male member 282 and a buckle female member 292 (the "catch" end). The male member 282 includes a male-member base 283 with a center guide 284 forwardly extending therefrom. Additionally extending from the male-member base 283, in the same general direction as the center guide 284, but spaced apart on either side therefrom, are first and second spring arms 285*a* and 285*b* terminating at a forward ends in, respectively, first and second retaining blocks 286*a* and 286*b*.

The female member 292 includes a female-member base 293 with a front open side 294, through which the center guide 284 and spring arms 285*a* and 285*b* are selectively received, and a first and second side receptacles 296*a* and 296*b* into which are received and retained, respectively, the outwardly-biased first and second retaining blocks 286*a* and 286*b* of the male member 282. When mutually coupled, the male and female members 282 and 292 are selectively separated by squeezing the outwardly-biased spring arms 285*a* and 285*b* toward one another so that the retaining blocks 286*a* and 286*b* are freed from the receptacles 296*a* and 296*b*, and the center guide 284 and spring arms 285*a* and 285*b* can be withdrawn from the front open side 294 of the female member 292.

In addition to the components enabling the selective coupling of the male and female members 282 and 292, each of the male-member and a female-member bases 283 and 293 defines apertures or straps slots through which the strap 230 can be fed and threaded in order to retain thereon the male and female members 282 and 292. More specifically, the male-member base 283 defines first and second strap slots 287*a* and 287*b* separated by a bifurcating strap bar 288. Similarly, the female-member base 293 defines first and second strap slots 297*a* and 297*b* separated by a bifurcating strap bar 298. The strap 230 is caused to carry the male member 282 by threading the strap 230 through one of the first and second strap slots 287*a* and 287*b*, folding the strap 230 over the strap bar 288, and threading the strap 230 through the other of the first and second strap slots 287*a* and 287*b*. It will be readily appreciated that the male member 230 can be selectively slid along the length of the strap 230.

Analogously, the strap 230 is caused to carry the female member 292 by threading the strap 230 through one of the first and second strap slots 297*a* and 297*b*, folding the strap 230 over the strap bar 298, and threading the strap 230 through the other of the first and second strap slots 297*a* and 297*b*. The female member 292 can be relocated (e.g. slid) along the length of the strap 230 in the same way as the male member 282. The ability of the male and female members 282 and 292 to be relocated along the length of the strap 230 permits a user to form upper and lower loops $\mathbf{220}_U$ and $\mathbf{220}_L$ of various relative sizes in a manner analogous to that discussed in association with the embodiment of FIGS. 5A-5C. The male and female members 282 and 292 may be slid along the strap 230 when they are mutually coupled (i.e., while the apparatus 10 is in a two-loop mode) or when they are mutually decoupled (i.e., when the apparatus 10 is in a single-loop mode).

Figure 8A:
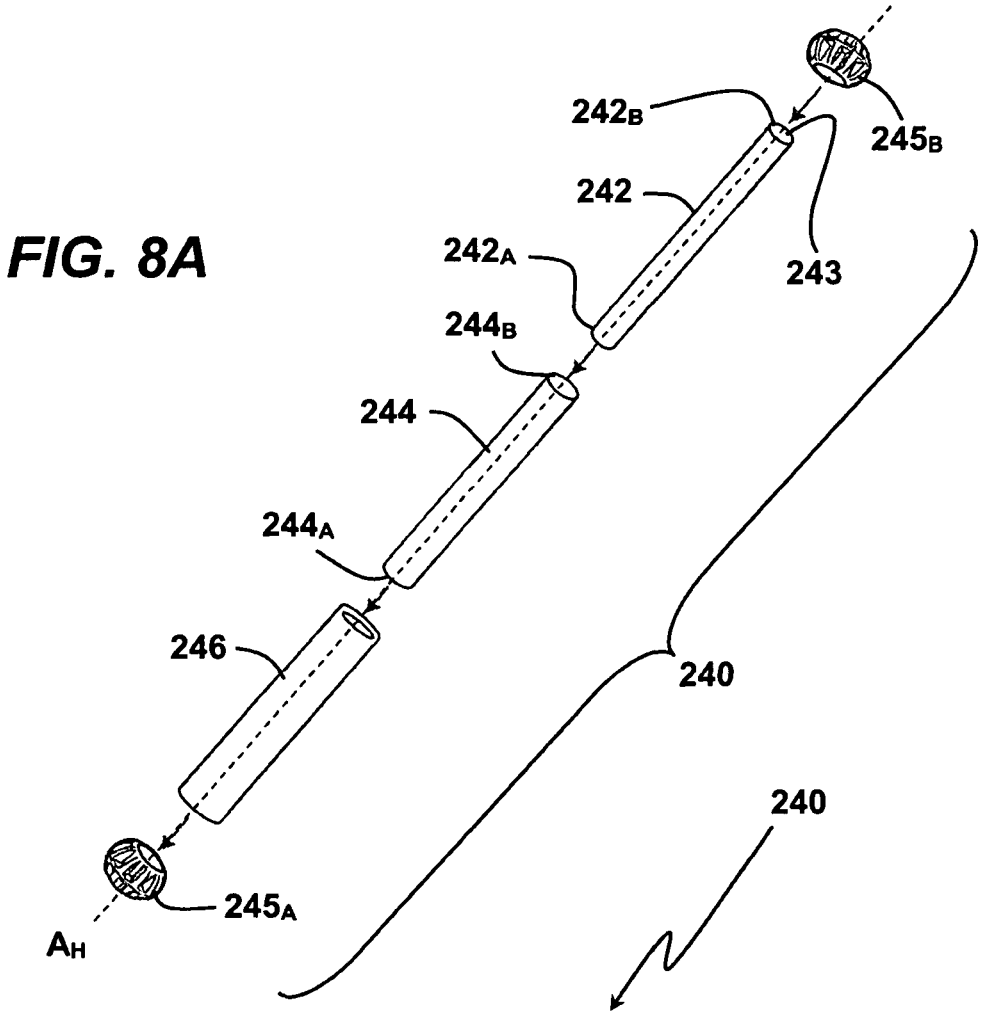
FIG. 8A is an exploded view of a handle member such as that illustratively incorporated into the apparatus of FIGS. 7A and 7B.
Figure 8B:
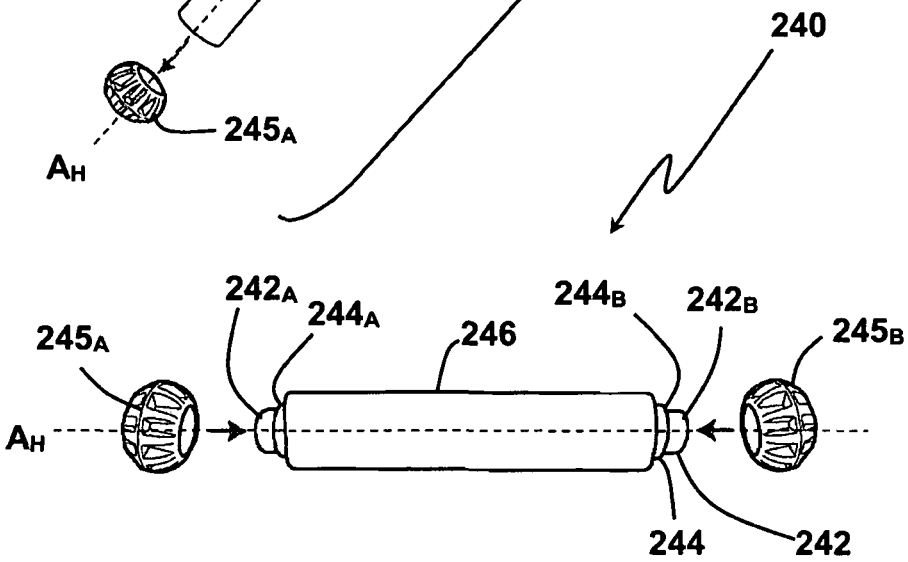
FIG. 8B is a semi-assembled view of the handle member of FIG. 8A.

As previously stated, embodiments of the present invention can be employed not only for muscle stretching, but also for myofascial release and trigger point therapy, the latter two functions being facilitated by the configuration of the handle member 240, irrespective of how other portions of the muscle stretching apparatus 10 are otherwise configured. With reference to FIGS. 8A and 8B, there are described, respectively, a "disassembled" or "exploded" view and a semi-assembled view of an illustrative handle member 240, such as that shown in an assembled state in FIGS. 7A and 7B. The handle member 240 includes a rigid cylindrical handle inner core 242, defining and extending along a handle axis $A_H$ between inner-core first and second ends $\mathbf{242}_A$ and $\mathbf{242}_B$, and a rigid cylindrical handle outer core 244 extending between outer-core first and second ends $\mathbf{244}_A$ and $\mathbf{244}_B$. Defined by and extending through the handle inner core 242 along the handle axis $A_H$ is a strap-passage channel 243 through which the strap 230 forming the loop 220 is threaded in order to retain the handle member 240 on the strap 230 and within the loop 220.

As best seen in FIG. 8B, the handle outer core 244 is shorter than the handle inner core 242 and configured for coaxial disposition about the handle inner core 242 such that the inner-core first and second ends $\mathbf{242}_A$ and $\mathbf{242}_B$ protrude out of the outer-core first and second ends $\mathbf{244}_A$ and $\mathbf{244}_B$. Coaxially affixed about the protruding inner-core first and second ends $\mathbf{242}_A$ and $\mathbf{242}_B$ are, respectively, first and second rolling end caps $\mathbf{245}_A$ and $\mathbf{245}_B$ which, at least within a cross-sectional center plane of each (not explicitly depicted, but readily conceivable, and therefor disclosed), are of a circular cross-sectional configuration. Although the diameters of the various components are not specifically labeled, it will be readily appreciated by inspection of FIGS. 7A, 7B, 8A and 8B that the diameter of rolling end cap $\mathbf{245}_A$ and $\mathbf{245}_B$ is larger than the diameter of the handle outer core 244 such that each rolling end cap $\mathbf{245}_A$ and $\mathbf{245}_B$ extends radially beyond the handle outer core 244. In various embodiments in which the handle outer core 244 includes a cylindrical cushioned grip 246 disposed thereabout, each of the rolling end caps $\mathbf{245}_A$ and $\mathbf{245}_B$ extends radially beyond the cushioned grip 246 as well.

The handle outer core 244 is carried by the handle inner core 242, and captured between the rolling end caps $\mathbf{245}_A$ and $\mathbf{245}_B$, such that the handle inner core 242 and rolling ends caps $\mathbf{245}_A$ and $\mathbf{245}_B$, while rotationally fixed relative to one another, can rotate with respect to the handle outer core 244 and, where applicable, the cushioned grip 246. The preceding configuration renders, in alternative modes, (i) the handle outer core 244—cushioned or not—usable for myofascial release and (ii) each of the rolling end caps $\mathbf{245}_A$ and $\mathbf{245}_B$ usable for trigger point therapy. By way of non-limiting example, a user might grasp one or both of the rolling end caps $\mathbf{245}_A$ and $\mathbf{245}_B$ and roll the handle outer core 244 over limbs, large muscle groups, foot arches, etc. for myofascial release. In an alternative mode, the handle outer core 244 can be grasped by a user—usually via a cushioned grip 246—so that at least one of the rolling end caps 245A and 245B can be rolled over trigger points on a person's body.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A muscle stretching apparatus comprising:

a main loop configured from at least one strap;

a handle member incorporated within the loop;

a foot-rest portion situated along the loop at a location generally opposite the handle member, wherein the at least one strap from which the loop is configured is inelastic, and a strap-constricting device carried by the loop and rendering the muscle stretching apparatus selectively transfiqurable between a first configuration defining the single main loop and a second configuration defining, by selective constriction of the main loop with the strap-constricting device, an upper loop including the handle member and a lower loop including the foot-rest portion.

2. The muscle stretching apparatus of claim 1 further comprising a foot saddle retained along the foot-rest portion and fabricated from a flexible material configured to wrap around a portion of a user's foot as the foot exerts force on the foot saddle.

3. The muscle stretching apparatus of claim 1 further comprising a buckle configured for selectively opening and closing the loop, wherein (i) the strap-constricting device is configured as a slide defining mutually separated left-side and right-side strap-guiding slots;

(ii) the slide is slidably carried by a first side of the loop extending between the handle member and the foot-rest portion by the passage of a portion of the strap from which the loop is configured through one of the left-side and right-side strap-guiding slots;

(iii) the buckle is permanently attached to a buckle-retaining strap end and situated between the handle member and the foot-rest portion on a second side of the loop extending between the handle member and foot-rest portion and being opposite the first side of the loop on which the slide is carried;

(iv) the loop includes a free strap end that can be alternatively inserted into and removed from the buckle such that the loop can be adjusted in size and alternatively opened and closed; and (v) the first configuration is such that only the first side of the loop passes through one of the left-side and right-side strap-guiding slots and the second configuration being such that the first side of the loop passes through one of the left-side and right-side strap-guiding slots and the second side of the loop passes through the other of the left-side and right-side strap-guiding slots, thereby defining a constricted region in the main loop that defines and mutually delineates the upper and lower loops associated with the second configuration.

4. The muscle stretching apparatus of claim 1 wherein the handle member includes at least one removable end cap which, when removed, opens the loop such that the handle member can be axially inserted into and through a cylindrical roller through which there is defined a handle-receiving bore configured for receiving the handle, the handle being greater in axial length than the handle-receiving bore such that the removable end cap can be secured to the handle member in order to retain the cylindrical roller about the handle member.

5. The muscle stretching apparatus of claim 4 further comprising a foot saddle retained along the foot-rest portion and fabricated from a flexible material configured to wrap around a portion of a user's foot as the foot exerts force on the foot saddle.

6. The muscle stretching apparatus of claim 1 wherein the handle member comprises:

(i) a rigid cylindrical handle inner core defining and extending along a handle axis between inner-core first and second ends, the handle inner core further defining along the handle axis a strap-passage channel that extends through the handle inner core, and through which strap-passage channel the strap forming the loop is threaded in order to retain the handle member on the strap and within the loop;

(ii) a rigid cylindrical handle outer core extending between outer-core first and second ends, and being shorter than and coaxially disposed about the handle inner core such that the handle inner-core first and second ends protrude out of the outer-core first and second ends and such that the handle inner and outer cores can rotate relative to one another about the handle axis; and (iii) first and second rolling end caps affixed to, respectively, the inner-core first and second ends and each rolling end cap having a circular cross-section with a diameter larger than the diameter of the handle outer core such that it extends radially beyond the handle outer core.

7. The muscle stretching apparatus of claim 6 further comprising a foot saddle retained along the foot-rest portion and fabricated from a flexible material configured to wrap around a portion of a user's foot as the foot exerts force on the foot saddle.

8. The muscle stretching apparatus of claim 2 wherein the strap-constricting device is a snap-fit side-release buckle comprising:

(i) a buckle male member retained by and on a first side of the loop between the foot saddle and the handle member; and (ii) a buckle female member retained by and on a second side of the loop opposite the first side of the loop and between the foot saddle and the handle member, the female buckle member being configured for selective decoupling and coupling with the buckle male member in order to render the muscle stretching apparatus into, respectively, the first and second configurations.

* * * * *